US006435652B1

(12) United States Patent
Rezanka

(10) Patent No.: US 6,435,652 B1
(45) Date of Patent: Aug. 20, 2002

(54) METHODS AND APPARATUS FOR FULL WIDTH PRINTING USING A SPARSELY POPULATED PRINTHEAD

(75) Inventor: Ivan Rezanka, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/732,727

(22) Filed: Dec. 11, 2000

(51) Int. Cl.[7] ..... B41J 2/155
(52) U.S. Cl. ..... 347/42; 347/13; 347/16
(58) Field of Search ..... 347/13, 42, 41, 347/12, 15, 43, 16

(56) References Cited

U.S. PATENT DOCUMENTS 6,250,738 B1 * 6/2001 Waller et al. ..... 347/42
6,293,651 B1 * 9/2001 Sawano ..... 347/40
6,315,390 B1 * 11/2001 Fujii et al. ..... 347/42

* cited by examiner

*Primary Examiner*—Lamson D. Nguyen

(74) *Attorney, Agent, or Firm*—Oliff & Berridge PLC

(57) ABSTRACT

A multi-pass printbar for providing full width printing on a recording medium is provided. The full width printing may be achieved by stepping the printbar in increments corresponding to the combination of the array width of a printhead die and the gap spacing between the printhead dies until full width print coverage on the recording medium occurs. Ink is ejected from an array of orifices on the printbar as the recording medium passes under the printbar. Alternatively, the full width printing may be achieved by fixing the printbar, and its array of orifices, but stepping the document handler, for example a recirculating drum document handler, the recording medium is mounted upon as it passes under the fixed printbar. Yet another alternative provides full width printing by providing a combination of motions of the printbar and a recirculating drum document handler simultaneously such that the printbar moves continuously and at a constant rate in a linear fashion while the recirculating drum document handler rotates the recording medium under the linearly moving printbar. The result is a "barber pole" style placement of printing information ink droplets on the recording medium which occurs repeatedly due to the rotational recirculation of the recording medium on the drum under the linearly moving printbar until full width print coverage is achieved.

14 Claims, 10 Drawing Sheets

METHODS AND APPARATUS FOR FULL WIDTH PRINTING USING A SPARSELY POPULATED PRINTHEAD

BACKGROUND OF THE INVENTION

1. Field of Invention

This invention relates to methods and apparatus for full width, multi-color printing using a multi-pass printbar.

2. Description of Related Art

A carriage-type ink jet printer commonly has a plurality of printheads mounted upon a reciprocating carriage. Each printhead is provided with its own ink tank cartridge. Arrays of orifices in each printhead are aligned perpendicular to the line of movement of the carriage. One or more colors of ink are provided in each of the printheads. The respective ink colors are ejected from the printhead through the orifices and onto the recording medium, providing a swath of information printed upon a stationary recording medium. The printhead carriage is moved in one direction across the processing path of the recording medium when printing a swath.

After printing the initial swath, the recording medium is stepped, perpendicular to the line of the carriage movement, by a distance equal to or less than the width of the printhead swath. The carriage is then moved in the reverse direction to print another swath of information. When the second swath of printing is completed, the recording medium is again stepped, in a distance equal to or less than the width of the printhead swath. This process is repeated until the full page printing is achieved.

Multi-color printing systems having a plurality of single-color ink jet printhead arrays require precise alignment of the ink-ejecting orifices to produce the desired spacing for each of the ink colors which are deposited in swaths upon an output sheet. Various embodiments of linear printhead arrays include staggered linear arrays attached to a substrate and substantially horizontal linear arrays. Either is intended to provide full-width printing on an output sheet.

A monolithic approach to forming the printhead array usually comprises four or more full-width printbars, each printbar being used for one ink. In the case of four printbars, each printbar ejects one of black, cyan, magenta or yellow ink. In printing with full-width printbars, only one relative motion of the set of four printbars is used. That is, either the receiving sheet is moved and the set of four printbars is stationary, or the set of four printbars is moved and the receiver sheet is stationary.

SUMMARY OF THE INVENTION

Conventional carriage-type ink jet printers can be used to print up to approximately six pages per minute in high quality printing. In conventional carriage-type ink jet printers, the set of four printheads address where each picture element on the receiver sheet is and eject ink droplets at 300 resolution of spots per inch or better. On the other hand, a conventional full-width type ink jet printer can be much more productive than the conventional carriage-type ink jet printer, though a conventional full width printer is more expensive. Thus, when using a conventional full-width type ink jet printer, printing is faster, but becomes economical only when printing at 20 pages per minute (ppm) and higher. A productivity gap exists, therefore, for printing from 6 ppm to 20 ppm that is difficult to service by conventional carriage-type ink jet printers and for which conventional full-width type ink jet printers are not an economical alternative. This invention provides systems and methods that fill this productivity gap and that satisfy the need to print economically in the range of 6 ppm to 20 ppm, as well as at lower and higher page rates.

Multi-pass printbars provided with an array of ink-ejecting orifices are known to provide full width print coverage on a recording medium. The printhead dies in such known printbars are abutted immediately adjacent one another to avoid swath alignment errors, such as stitch errors. The adjacent printhead dies of known printbars are also known to provide unproductive swath overlaps in order to hide or eliminate swath alignment errors.

This invention provides multi-pass printing using a printbar having printhead dies that are spaced apart from one another while still providing full-width print coverage upon a recording medium. The printhead dies are provided with an array of ink-ejecting orifices similar to known printbars. However, the spacing of the dies uses movement of either, or both, of the printbar and the recording medium to produce the full-width printing effect.

In various exemplary embodiments of the full-width printbar apparatus and methods of this invention, the printbar having printhead dies spaced apart from one another is incorporated into a flatbed printing environment such that the recording medium remains stationary while the printbar moves over the recording medium to eject ink droplets upon the recording medium. In this embodiment, the printbar generates an initial set of swaths of information by ejecting ink from its array of ink-ejecting orifices while the array of spaced-apart printhead dies of the printbar is located, for example, at a first position.

After the initial set of swaths is completed, the printbar is stepped laterally to locate the array of spaced apart printhead dies at, for example, a second position where the next set of swaths of information is positioned, for each color in the next set of swaths, immediately adjacent to, or overlapping, the initial set of swaths of information for that color. The printbar undergoes successive stepping after the completion of each set of swaths until full-width print coverage is achieved on the recording medium. Alternatively, the flatbed printing environment supporting the recording medium can be stepped laterally instead of the printbar.

In various other exemplary embodiments, the printbar is stepped in successive swath widths while the recording medium is recirculated or reciprocated upon a drum or other recirculating or reciprocating document handler. Thus, for example, with each rotation of the drum, the printbar is stepped to the next position such that each succeeding set of swaths of information is imparted to the recording medium until full-width printing of the image upon the recording medium is achieved.

In still other various exemplary embodiments, the printbar is continuously moved in a linear fashion at a constant rate across a recording medium moving past the printbar upon a recirculating drum, or other recirculating or reciprocating document handler. Thus, for example, as the drum rotates the recording medium, the printbar's constant linear motion permits ink to be ejected from orifices in its printhead dies to the recording medium similar to the various previously described exemplary embodiments. However, the linear motion of the printbar causes the swaths of ink ejected from the printhead dies to appear upon the recording medium in an angular, or "barber pole", fashion when coupled with the motion imparted to the recording medium as a result of the recirculating drum, or other recirculating or reciprocating document handler.

In various exemplary embodiments, the receiving media may be placed on the drum or other document handler in an angled or slightly skewed fashion. The printbar is placed at a correspondingly small angled position relative to the recirculating axis of the document handler to achieve an optimum alignment of the printed images or text upon the receiving medium.

The combination of motions provide full-width print coverage upon the recording medium as the printhead dies will scan across the recording medium in time due to the continous and constant travel rate of the printbar while the drum moves the recording medium past the printbar. The angularly-oriented sets of swaths of information are provided in similar abutting, or overlapping, form as the various previously described exemplary embodiments to provide full width coverage. By controlling the rate of motions of the linearly moving printbar and the moving drums, proper swath alignment is achieved.

In still other various exemplary embodiments, the printbar, its printhead dies and ink-ejecting orifices remain stationary while the drum or other recirculating or reciprocating document handler is stepped after each set of swaths of information is completed. Stepping the drum occurs in swath-width or less increments until full-width print coverage upon the recording medium is achieved.

These and other features and advantages of this invention are described in or are apparent from the detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF EXEMPLARY EMBODIMENTS

Printing over the full-width of a recording medium requires either a printbar that has one print element for every pixel across the recording medium at the print resolution, or motion in two directions.

Previously, printing using full-width printbars required carefully manufacturing and mounting a large number of printhead dies. In particular, the printhead dies had to be manufactured and mounted such that the spacing, or pitch, between adjacent printing elements was consistent both within each printhead die, as well as across the boundary between adjacent printhead dies. Full-width printbars thus required expensive manufacturing and mounting techniques. The required printhead dies often suffered from very low manufacturing yield. However, full-width printbars have very high printing through-put rates, because an image can be printed upon a sheet of recording material in a single pass.

In contrast, printing using scanned printheads mounted upon a carriage has significantly reduced manufacturing and mounting requirements relative to a full-width printbar. In particular, only a few printheads of each color, and possibly only one printhead of each color, are required. Moreover, because the printheads are scanned in two directions over the sheet of image recording material, rather than being stationery in one direction as in full-width printbars, misalignments between printheads can be compensated for electronically. However, printing using printheads mounted on a scanned carriage requires more expensive mounting structures, suitable to scan the printhead across the recording medium, than full-width printbars. Moreover, because the printheads must be scanned across the recording medium to print swaths of the image, and each swath covers only a small amount of the recording medium, scanned printhead type printing has a very low through-put rate.

Thus, a printhead that can combine the advantages of both full-width and scanned printheads would be desireable.

Figure 1:
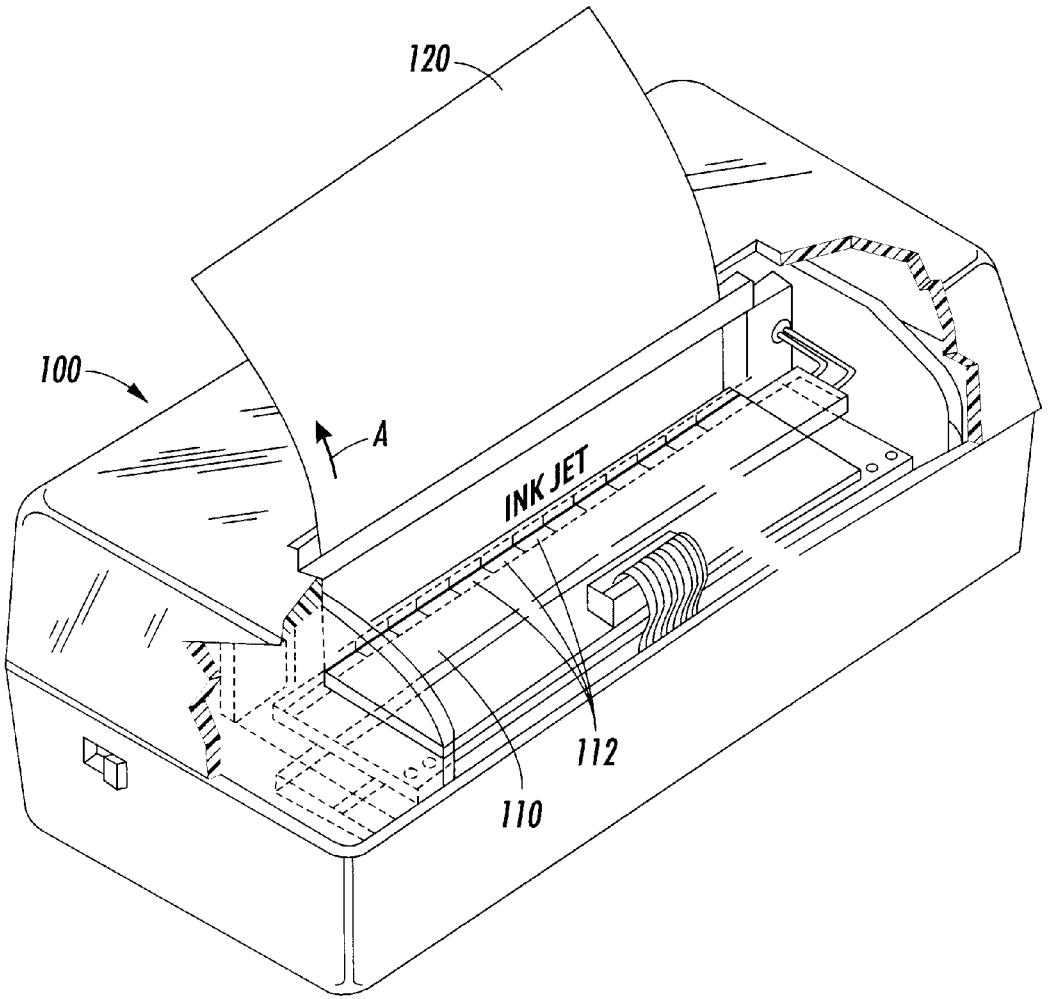
FIG. 1 PRIOR ART
FIG. 1 is a cutaway view of a printer that includes a conventional full-width printbar.
Figure 2:
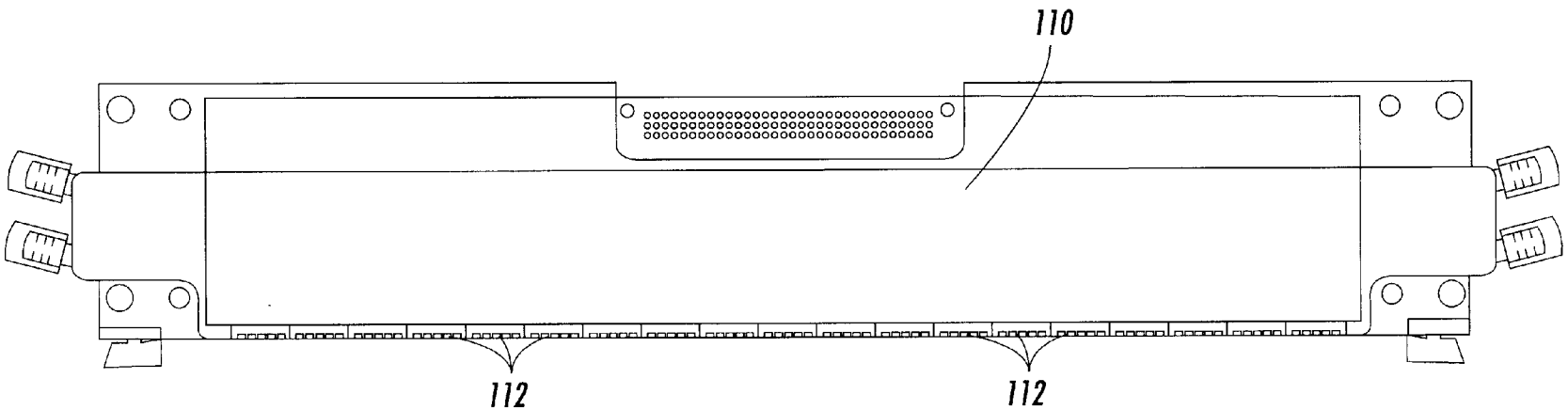
FIG. 2 PRIOR ART
FIG. 2 is a plan view of one conventional full-width printbar with printhead arrays in abutting position.

FIG. 1 shows a cutaway view of a known printer 100 in which a full-width printbar 110 having a plurality of printhead dies 112 are used to eject ink from the printhead dies 112 to a recording medium 120, such as, for example, a sheet of paper. FIG. 2 shows a plan view of the full-width printbar 110 used in the conventional printer shown in FIG. 1. The full-width printbar 110 shown in FIG. 1 and FIG. 2 aligns the various printhead dies 112 in abutting fashion such that each printhead die 112 abuts immediately next to its neighboring printhead die 112. Each printhead die 112 is provided with a number of arrays of nozzles, where each nozzle array is usable to eject one of a set of ink colors, such as, for example, black, cyan, magenta and yellow. In this configuration, full-width printing of an image on the recording medium 120 is achieved by ejecting ink droplets of different sizes from the printhead dies 112 onto the recording medium 120 as the recording medium 120 passes in front of the full-width printbar 110 in a slow scan, or process, direction, as indicated by arrow A in FIG. 1.

The recording medium 120 moves continuously past the full-width printbar 110 to print the image on the recording medium 120. In other exemplary embodiments, each full-width printbar ejects only a single color of ink. In this case, a plurality of the printbars 110 are provided along the slow scan direction A to allow for full color printing. In this case, each full-width printbar 110 ejects a different color ink.

Figure 3:
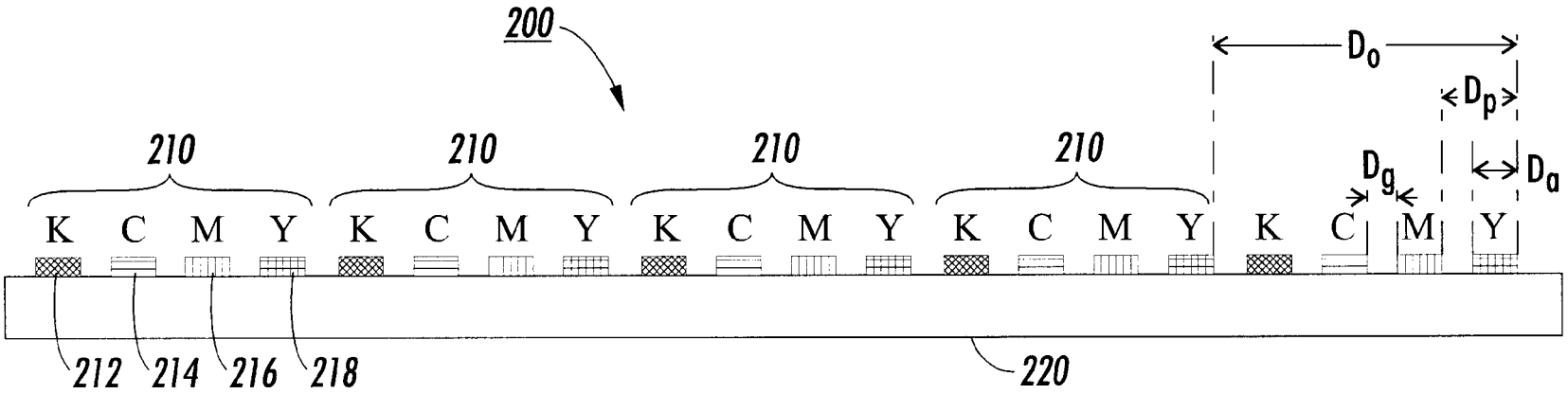
FIG. 3 is a schematic drawing of a first exemplary embodiment of the sparsely populated printbar according to this invention showing the spaced apart arrays upon the printbar.

FIG. 3 shows a first exemplary embodiment of a sparsely populated printbar 200 according to this invention. The printbar 200 includes a plurality of sets 210 of printhead dies 212, 214, 216 and 218. Each of the printhead dies 212, 214, 216 and 218 eject one of four distinct colors, such as, for example, black (K), cyan (C), magenta (M) and yellow (Y). Each printhead die 212, 214, 216 and 218 of a set 210 has an array of ink ejecting elements, or nozzles, through which the variously colored inks are ejected. The ink ejecting elements, or nozzles, each have an array width $d_a$. A spacing gap $d_g$ is provided between each printhead die 212, 214, 216 and 218, causing the printbar 200 to have a sparsely populated quality according to this invention. In various exemplary embodiments, four differently colored ink ejecting printhead elements, or dies, comprise a set 210. In various other exemplary embodiments, the set 210 can include fewer or more different printhead dies to print using fewer or more colors. In various other exemplary embodiments, the set 210 can include fewer different printhead dies if each printhead die has two or more arrays that each eject a differently colored ink.

In various other exemplary embodiments, the array width $d_a$ is less than the total width of each printhead die 212, 214, 216 or 218, because the ink ejecting elements, or nozzles, forming the array on each printhead die 212, 214, 216 or 218 are located at least a nominal distance from the edges of each printhead die 212, 214, 216 or 218. The location of the ink ejecting elements, or nozzles, away from the edges of the printhead dies 212, 214, 216 and 218 is possible due to the sparsely populated nature of the printbar 200 according to the invention. Locating the ink ejecting elements, or nozzles, away from the edges of the printhead dies 212, 214, 216 and 218 differs from previous full width printbars, which placed printhead dies immediately adjacent a neighboring printhead die in abutting fashion and from end to end on a printbar to provide full-width coverage of the recording medium. By locating the printhead dies 212, 214, 216 and 218 in sparsely populated fashion, the invention minimizes damage to the ink ejecting elements, or nozzles, of a printhead die, such as printhead dies 212, 214, 216 or 218, located near the lateral edges of the printhead die.

In the exemplary embodiment shown in FIG. 3, each set 210 of the printhead dies 212, 214, 216 and 218 is offset relative to its neighboring set 210 by an offset distance $d_o$. Each printhead die 212, 214, 216 and 218 within a single set 210 is offset relative to an adjacent printhead die within the same set 210 by a pitch distance $d_p$ from its immediately neighboring printhead die. The offset distance do can be an integer multiple of the pitch distance $d_p$, but does not need to be so.

Thus, the array width $d_a$ of the printhead dies 212, 214, 216 and 218, the gap spacing distance $d_g$ between the printhead dies 212, 214, 216 and 218 of a set 210, and the amount of overlap between each swath determines the number of steps a printbar 200 or a document handler, for example, a recirculating drum document handler 250, must make to cover the full width of the recording medium, for each color, with successive swaths. For example, the swaths $\mathbf{232}_a$–$\mathbf{232}_e$ of print information shown in FIG. 4 corresponding to the black K color ink only for clarity demonstrates one manner in which the array width $d_a$, gap spacing $d_g$ and any amount of overlap between swaths orient themselves to produce full width coverage of print information $\mathbf{232}_a$–$\mathbf{232}_e$ upon a recording medium 230. It should be appreciated that the successive swaths, for example $\mathbf{232}_a$–$\mathbf{232}_e$, are printed for each different ink color, for example, black (K), cyan (C), magenta (M) and yellow (Y). Placing the print information $\mathbf{232}_a$–$\mathbf{232}_e$ in proper alignment upon a recording medium 230 in this manner reduces unnecessary or unproductive overlapping of printing information or undesirable gaps or omissions of printing information between successive swaths.

In one exemplary embodiment of the sparsely populated print bar 200 according to this invention, the dimensions of the printhead dies 212, 214, 216 and 218 of a set 210, and the various related distances comprising the sparsely populated printbar 200 of this exemplary embodiment are related such that:

$$d_a < d_p - d_g; \text{ and} \tag{1}$$

$$nd_a = 4d_p = d_o \tag{2}$$

where:

$d_g$ is the gap spacing distance between neighboring printhead dies;

$d_p$ is the pitch distance from any point of one printhead die to a corresponding point of an immediately neighboring printhead die;

$d_a$ is the array width of the array of ejection nozzles of each printhead die;

$d_o$ is the offset distance of one set 210 of the printhead dies relative to a neighboring adjacent set 210 of the printhead dies; and n is an integer larger than or equal to 5.

It should be appreciated that while the exemplary embodiment shown in FIG. 3 depicts various sets 210 of the printhead dies 212, 214, 216 and 218 in a substantially horizontally linear configuration relative to one another, the same sets 210 of the printhead dies 212, 214, 216 and 218 could be provided in a non-linear configuration, as in a staggered form, relative to one another so long as the dimensional relationships permit full-width print information coverage on the recording medium.

Figure 4:
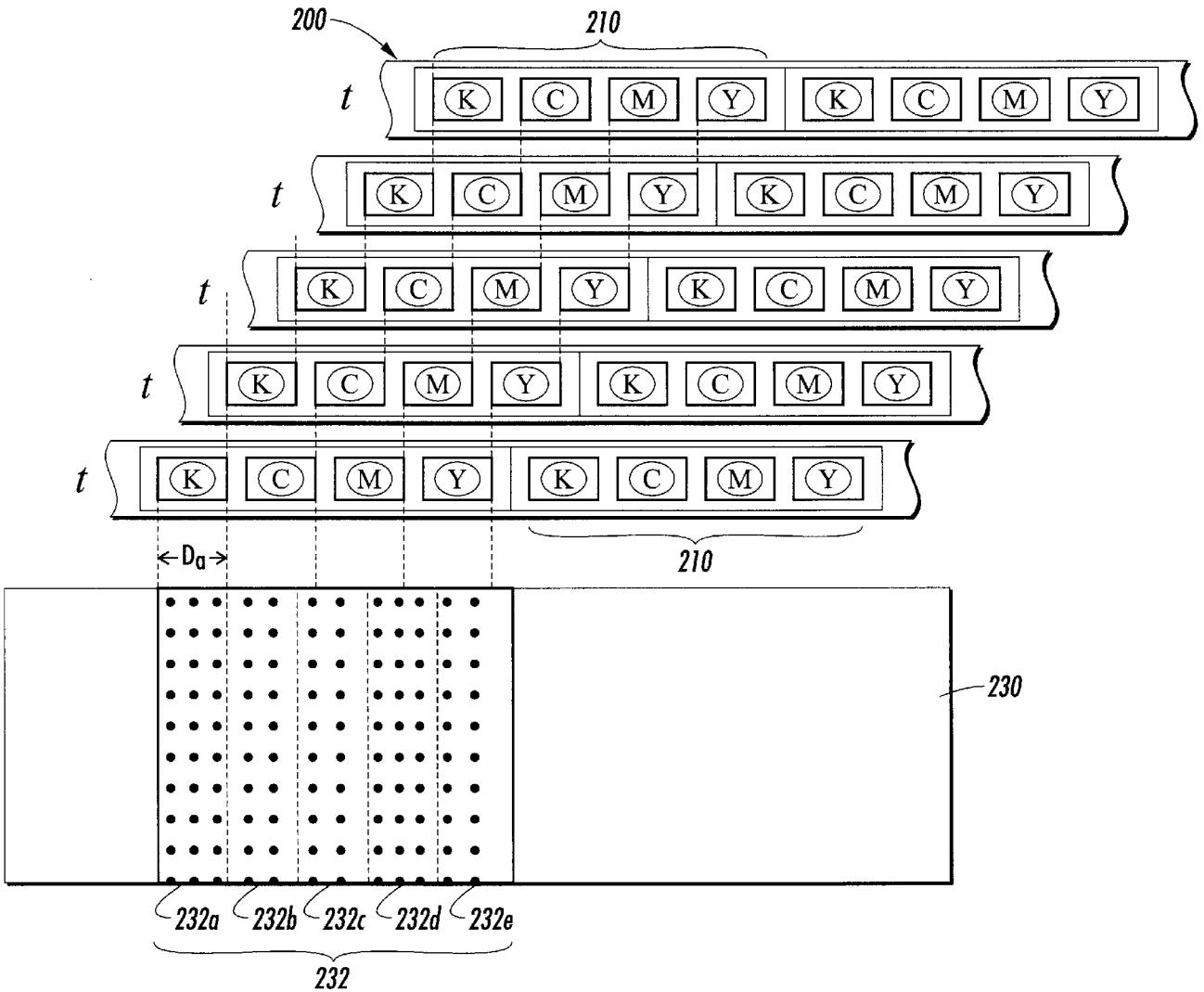
FIG. 4 illustrates one exemplary embodiment of the reciprocating motion used to scan the sparsely populated printbar of FIG. 3 according to this invention where the printbar or the recording medium is stepped to achieve full-width print coverage upon the recording medium.

FIG. 4 depicts a cut-away top plan view of an exemplary embodiment of a set 210 of the printbar 200 of FIG. 3. Assuming, for example, the offset distance $d_o$ of each set 210 is ½ inch, and the array width $d_a$ of each printhead die 212, 214, 216 and 218 is 1/10 inch, i.e., $d_a/5$, then the pitch distance $d_p$ is ⅛ inch, i.e. $d_a/4$ as shown in the relationships in FIG. 3. Such a configuration permits full width printing upon a recording medium 230 such as, for example, a standard sized paper sheet, i.e., 8.5 inches×11 inches, in multiple swaths $\mathbf{232}_a$–$\mathbf{232}_e$ by stepping the printbar 200 in five 1/10 inch increments equal to an individual printhead's array width $d_a$ until all of the desired print coverage is achieved for each color. Again, while FIG. 4 shows, for clarity, only the single ink color black K deposited in swaths $\mathbf{232}_a$–$\mathbf{232}_e$ upon the recording medium 230, for example, it should be appreciated that all of the other remaining ink colors are deposited in similar fashion upon the recording medium 230 during the same pass of the printbar 200 over the recording medium 230. It should be further appreciated that, while FIG. 4 shows incremental stepping of the printbar 200 to accomplish the successively oriented swaths $\mathbf{232}_a$–$\mathbf{232}_e$ of printing upon the recording medium 230, stepping of the recording medium 230 may instead be performed to accomplish the desired successive swaths $232_a$–$232_e$ of printing information as, for example, where the recording medium 230 is placed upon a recirculating drum document handler 250 or other document handler and the printbar 200 is fixed. Still further, it should be appreciated that while the incremental stepping necessary to properly align successive swaths of printing information upon a recording medium may be achieved by stepping either only the printbar 200 or only the document handler, for example a recirculating drum document handler 250, the successive swaths $232_a$–$232_e$ may also be achieved by a combination of movements of the printbar and the document handler.

The two motions required for full-width printing upon a recording medium 230 may be achieved by moving a printbar 200 stepwise horizontally across a recording medium 230 and vertically along the recording medium as occurs in known carriage-type printers. Alternatively, the two motions may be achieved by fixing the printbar 200 and moving the recording medium 230 upon, for example, a recirculating drum document handler 250 that rotates the recording medium 230 below the fixed printbar 200 and horizontally steps the drum in designated stepping increments $d_s$, as shown in FIG. 5, where $d_s \leqq d_a$.

Figure 6:
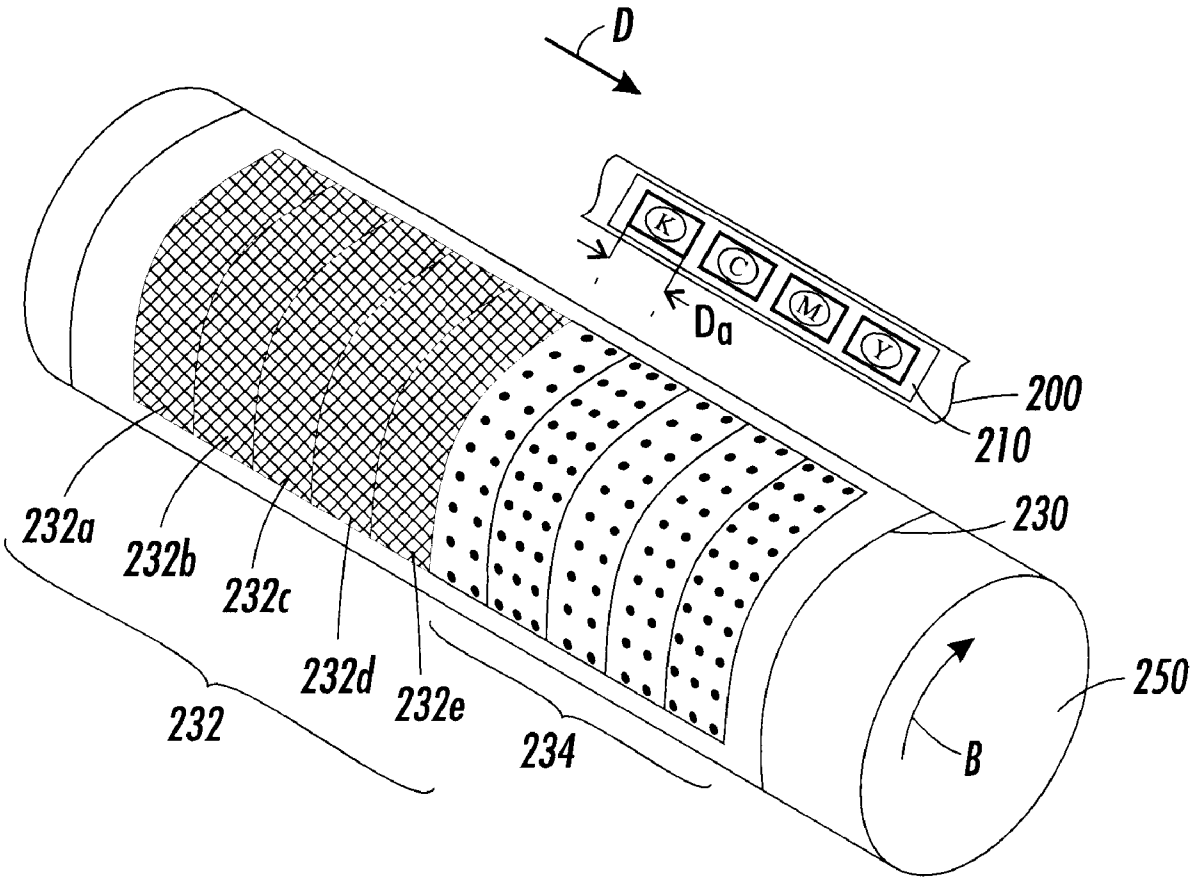
FIG. 6 illustrates one exemplary embodiment of stepping a printbar in increments in combination with a rotating recirculating drum to scan the sparsely populated printbar of FIG. 3 according to this invention to achieve full-width print coverage upon the recording medium.

Still further, the two motions may be achieved by moving the printbar 200 stepwise horizontally across the recording medium while the recording medium 230 is rotated upon, for example, a recirculating drum document handler 250 positioned below the printbar, as shown in FIG. 6. Yet another way of achieving the two motions is to continuously move the printbar 200 or the recirculating drum document handler 250 in a linear fashion while rotating the recording medium 230 upon, for example, the recirculating drum document handler 250 that rotates the recording medium 230 relative to the printbar 200. Conceivably, the two motions could be achieved by fixing the recording medium in a single position on a non-recirculating drum while rotating a printbar 200 about the recording medium 230 and moving the printbar 200 or the recirculating drum document handler 250 stepwise horizontally across the recording medium 230 until the desired print coverage is attained.

The printbar 200 according to this invention includes a plurality of sets 210 of printhead dies 212, 214, 216 and 218. Thus, each set 210 of the printhead dies 212, 214, 216 and 218 produce similar overall swaths 232 comprised of, for example incremental swaths $232_a$–$232_e$, print information upon the recording medium 220 at the same time as the set 210 shown in FIG. 4. Thus, the total amount of stepping required is limited.

Figure 5:
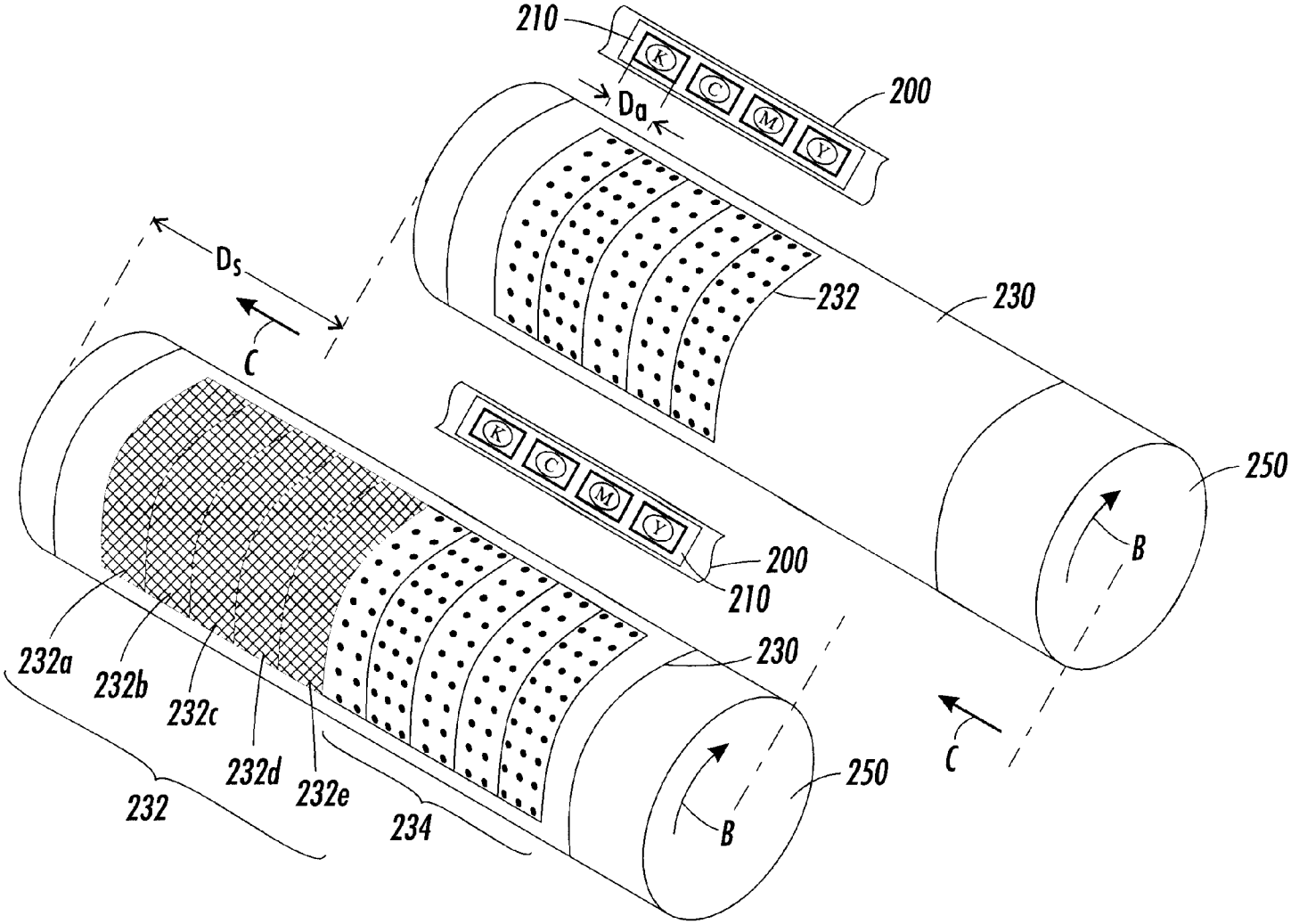
FIG. 5 illustrates one exemplary embodiment of stepping a recirculating drum in increments to scan the sparsely populated printbar of FIG. 3 according to this invention to achieve full-width print coverage upon the recording medium.

FIG. 5 shows a second exemplary embodiment of the sparsely populated printing systems according to this invention, where the printbar 200 is fixed in both directions while the recording medium 230 is mounted upon a recirculating drum document handler 250. The recirculating drum 250 rotates in the direction of arrow B to position the recording medium 230 under the printbar 200 so that the swaths $232_a$–$232_e$ of the printing information may be ejected from the various printhead dies 212, 214, 216 and 218 onto the recording medium 230. At the completion of the first swath $232_a$, shown as an incremental swath comprising part of the shaded overall swath 232 to distinguish it from the second subsequent overall swath 234 also comprised of incremental swaths $234_a$–$234_e$, the recirculating drum document handler 250 is stepped linearly the step distance $d_s$ in the direction of arrow C to re-align the recording medium 230 under the sets 210 of various printhead dies 212, 214, 216 and 218 of printbar 200 so that the next or subsequent swaths, for example $232_b$ and $234_b$, of the printing information can be placed onto the recording medium 230 in an alignment to minimize the likelihood of stitching errors between the swaths and between the sets of overall swaths 232 and 234, for example. The stepping process is repeated, similarly to that process set forth in the previously-described exemplary embodiments, until the desired printing coverage upon the recording medium 230 is achieved. As in the previously-described exemplary embodiments, the array width $d_a$ of the ink ejecting nozzles of the printhead dies 212, 214, 216 and 218, the gap spacing distance $d_g$ between the printhead dies 212, 214, 216 and 218 and the amount of overlap, i.e., the relationship between $d_a$ and $d_g$, determines the number and size of the stepping increments $d_s$ required to achieve full-width printing coverage on the recording medium 230.

FIG. 6 shows a third exemplary embodiment of the sparsely populated print bar printing systems according to this invention, where the printbar 200 moves in combination with the rotation of the recirculating drum document handler 250. For instance, as in the exemplary embodiment described with reference to FIG. 5, the recording medium 230 is mounted upon the recirculating drum document handler 250. The recirculating drum document handler 250 is again rotated in the direction of the arrow B. The recirculating drum document handler 250 in this exemplary embodiment, however, does not step linearly, as in the exemplary embodiment shown in FIG. 5. Rather, the printbar 200 is stepped in the direction of the arrow D after completing each swath $232_a$–$232_e$ of the set of swaths 232, for example, of the printing information, so that the recording medium 230 is properly aligned to receive the variously colored inks ejected from the printhead dies 212, 214, 216 and 218 of each set 210 in each subsequent swath $232_b$–$232_e$ in the set of swaths 232. Again, the process is repeated until all necessary swaths in the sets of swaths of the printing information are provided on the recording medium 230 to achieve the full-width print coverage desired. In FIG. 6, the first set of swaths 232 of the printing information is shown as shaded.

In any of the exemplary embodiments involving stepping, in which either the printbar 200 or the recirculating drum document handler 250 is stepped, the stepping may be controlled, for example, by a timer, a motor, an encoder, or any other suitable known or later developed device, or some combination of such devices. In the case of a timer, stepping occurs when a designated end of swath signal is detected indicating that the preceding swath of information is completed. A motor thus energizes either the printbar 200 or the recirculating drum document handler 250 to move the appropriate step distance $d_s$ as indicated, for example, in FIGS. 4–6. For example, using FIG. 4 as illustrative, at a time t, each set 210 of printhead dies 212, 214, 216 and 218 assumes an initial position such that the set 210 of the printhead dies 212, 214, 216 and 218 is aligned to eject an initial set of swaths 232 of the printing information onto the recording medium 230 when printing is initiated. Printing thus occurs as ink is ejected from the various printhead dies 212, 214, 216 and 218 onto the recording medium 230 while the printbar 200 slowly scans, or passes, over the recording medium 230 in the direction of the arrow B. At a time t, just after an end of swath signal is detected, the initial swath of each set of swaths is presumed to be complete. The printbar 200 is stepped by the distance $d_s$ to a next ejecting position. Subsequent positions of the printbar 200 are achieved at times $t_3$–$t_6$ upon the end of swath signal being detected. Stepping the printbar 200, for example, in this fashion similarly aligns each set 210 so that the printhead dies 212, 214, 216 and 218 of that set 210 can eject the variously colored inks, black (K), cyan (C), magenta (M) and yellow (Y) onto the recording medium 230 in adjacent swaths while reducing the occurrence of stitch errors between the swaths in adjacent sets of swaths. Thus the number of positions each set 210 of printhead dies 212, 214, 216 and 218 will be stepped to is equivalent to the number of steps described earlier and each step is interleaved in time to ensure proper set 210 alignment.

In the case of an encoder, a sensor measures the position of the printhead dies 212, 214, 216 and 218 relative to the recording medium 230. Thus, for example, when a first position of the black (K) ink printhead die 212 is located at the bottom of a recording medium 230, the completion of a first set of swaths 232 is determined and either the printbar 200 or recirculating drum document handler 250 is energized to move the appropriate step increment $d_s$ to provide the second or next swath in each set of swaths 232, 234 and the like of the printing information in alignment with the immediately preceding swath of the sets of swaths of the print information. Again, the number of positions a set 210 of the printhead dies 212, 214, 216 and 218 will be stepped to is equivalent to the number of steps described earlier. It should be appreciated that any known or later developed technique for determining the end of a swath can be used in this invention.

The stepping methods and mechanisms according to this invention provide clear, clean vertical swaths of printing information on a recording medium. The clarity of the swaths therefore minimizes the need to perform repeat printing of pages due to improper swath alignment resulting in printing gaps or other smeared or illegible printing of information on the recording medium.

Figure 7:
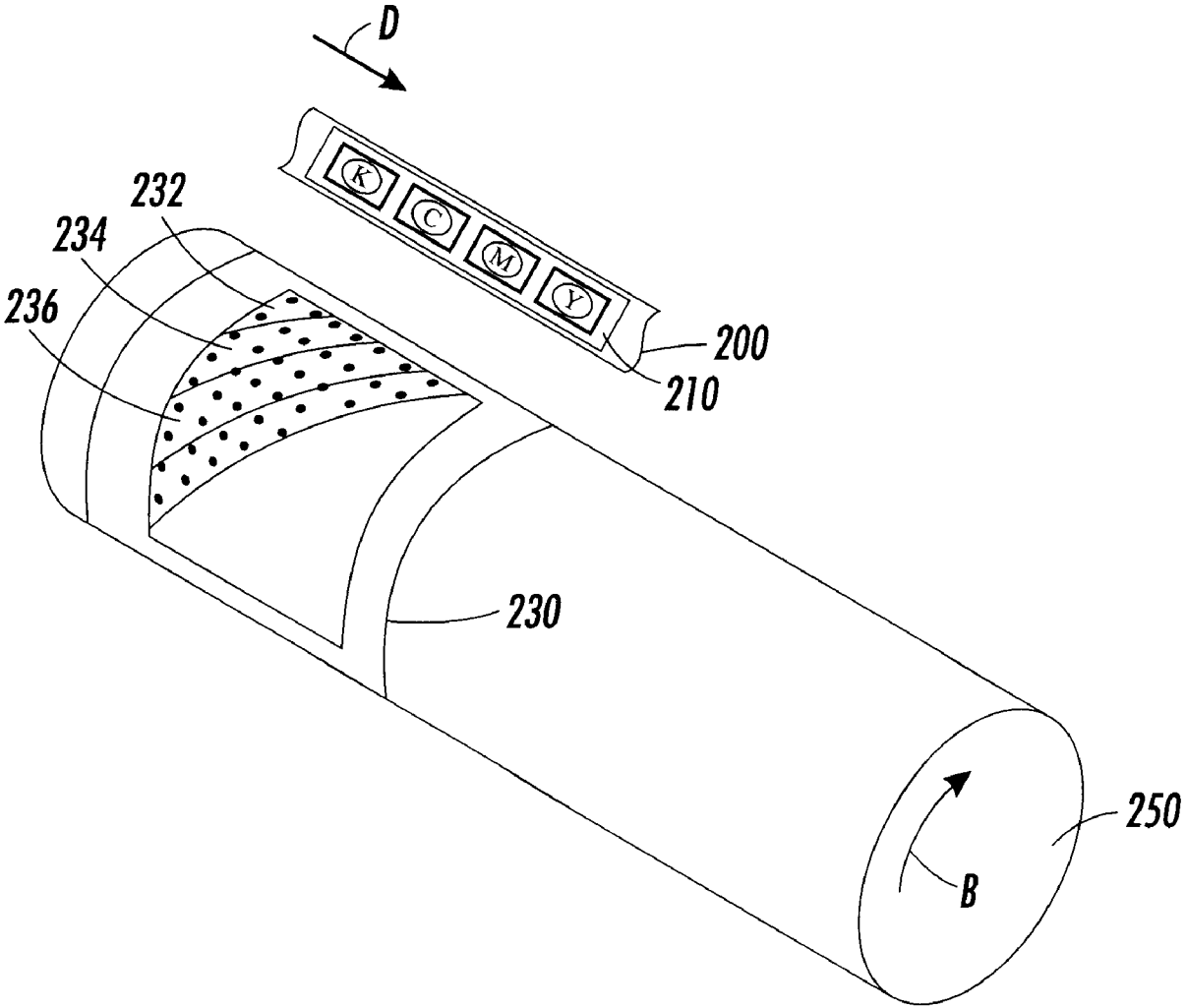
FIG. 7 illustrates one exemplary embodiment of moving the printbar at a constant linear motion in combination with the rotating recirculating drum to scan the sparsely populated printbar of FIG. 3 according to this invention to achieve full-width print coverage upon the recording medium in "barber pole" fashion.

FIG. 7 shows still another exemplary embodiment of the invention in which the printbar 200 and the recirculating drum document handler 250 also move in combination with one another. However, in this exemplary embodiment, discrete stepping increments $d_s$ of either the printbar 200 or the recirculating drum document handler 250 do not occur. Instead, the recording medium 230 is mounted upon a recirculating drum document handler 250 that is rotated in the direction of arrow B to pass the mounted recording medium 230 under the printbar 200 as the rotation of the recirculating drum document handler 250 occurs. The printbar 200 is moved "continuously" at a constant rate above the recirculating drum document handler 250, at least when the print bar 200 is within a printing area of the recording medium 230. The combination of motions of the printbar 200 and the recirculating drum document handler 250 produces angularly-deposited "barber pole" style sets of swaths 232, 234 and 236 of the printing information upon the recording medium 230 as the recording medium 230 is exposed to the various printhead dies 212, 214, 216 and 218 of the printbar 200. Because the linear motion of the printbar 200 occurs at a constant rate, no incremental stepping of either the printbar 200 or the recirculating drum document handler 250 is necessary. The rate of linear motion of the printbar 200 is determined according to the printing area of the recording medium 230, the array width dimensions $d_a$ of the printhead dies 212, 214, 216 and 218, the gap spacing distance $d_g$ between the printheads 212, 214, 216 and 218, and the amount of overlap between adjacent swaths. As a result, this "barber pole" technique provides angular sets of swaths of the printing information in a smooth manner across a recording medium 230. While the printing information placed on the recording medium 230 may be slightly angled or skewed relative to the recording medium's edges, the smooth placement of inks from the printbar 200 to the recording medium using the "barber pole" method minimizes the risk of start and stop, and/or stitching errors the stepping method and mechanisms can be prone to.

Figure 8:
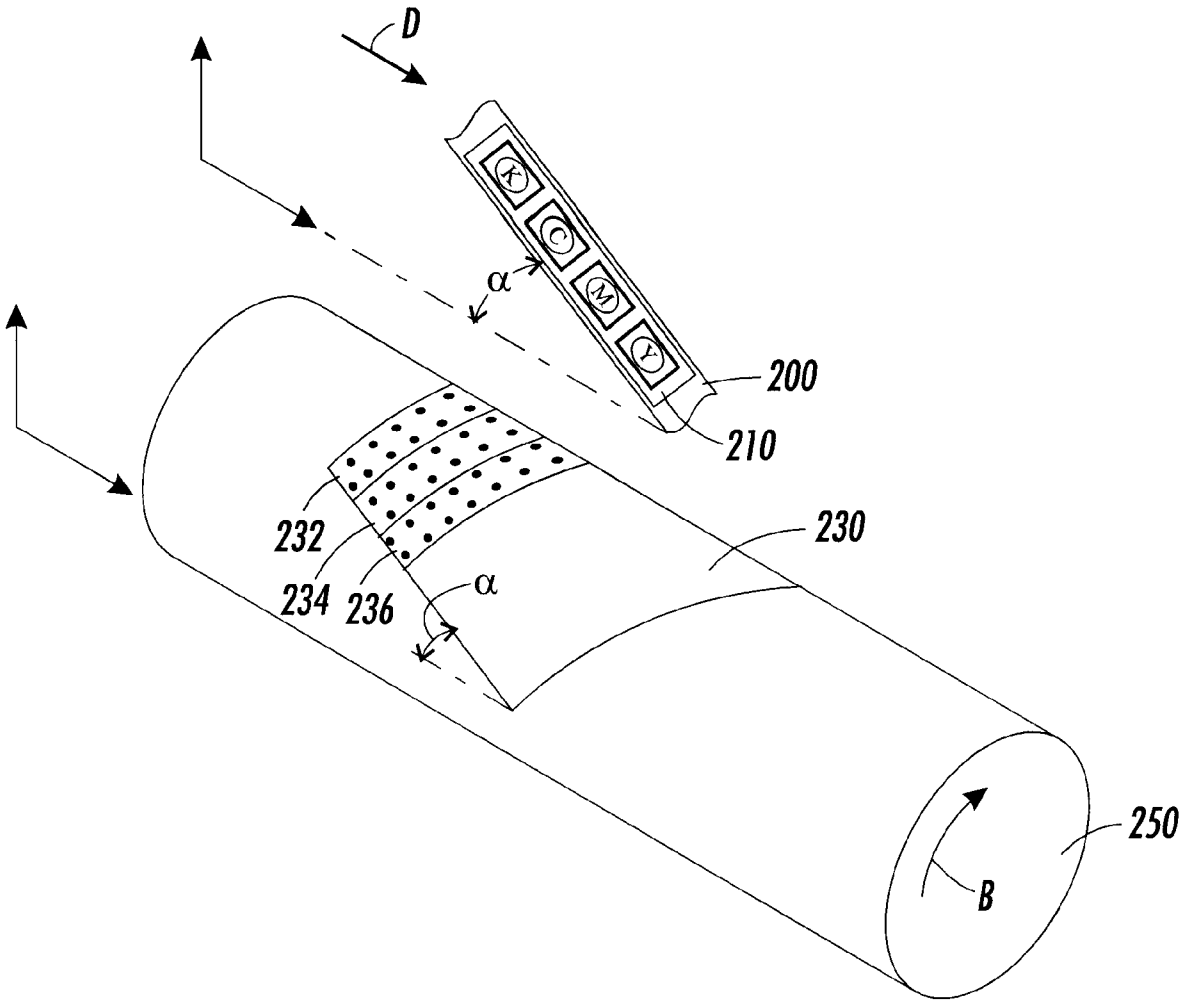
FIG. 8 illustrates another exemplary embodiment of moving the printbar at a constant linear motion in combination with the rotating recirulating drum by angling.

FIG. 8 shows another exemplary embodiment of the invention in which the "barber pole" style sets of swaths 232, 234 and 236 of the printing information are deposited upon the recording medium 230 by setting the recording medium 230 at an angle $\alpha$ relative to the recirculating axis of the document handler 250. The printbar 200 is set at a corresponding angle $\alpha$. In this instance, the linear motion of the printbar again occurs at a constant rate. Therefore, no incremental stepping of either the printbar 200 or the recirculating document handler 250 is necessary. Because of the correspondingly skewed positions of the printbar 200 and the recording medium 230 upon the recirculating document handler 250, straight, clear, vertical and horizontal alignments of the printing information upon the recording medium 230 is achieved while the printbar 200 and recording medium 230 move relative to one another.

Figure 9:
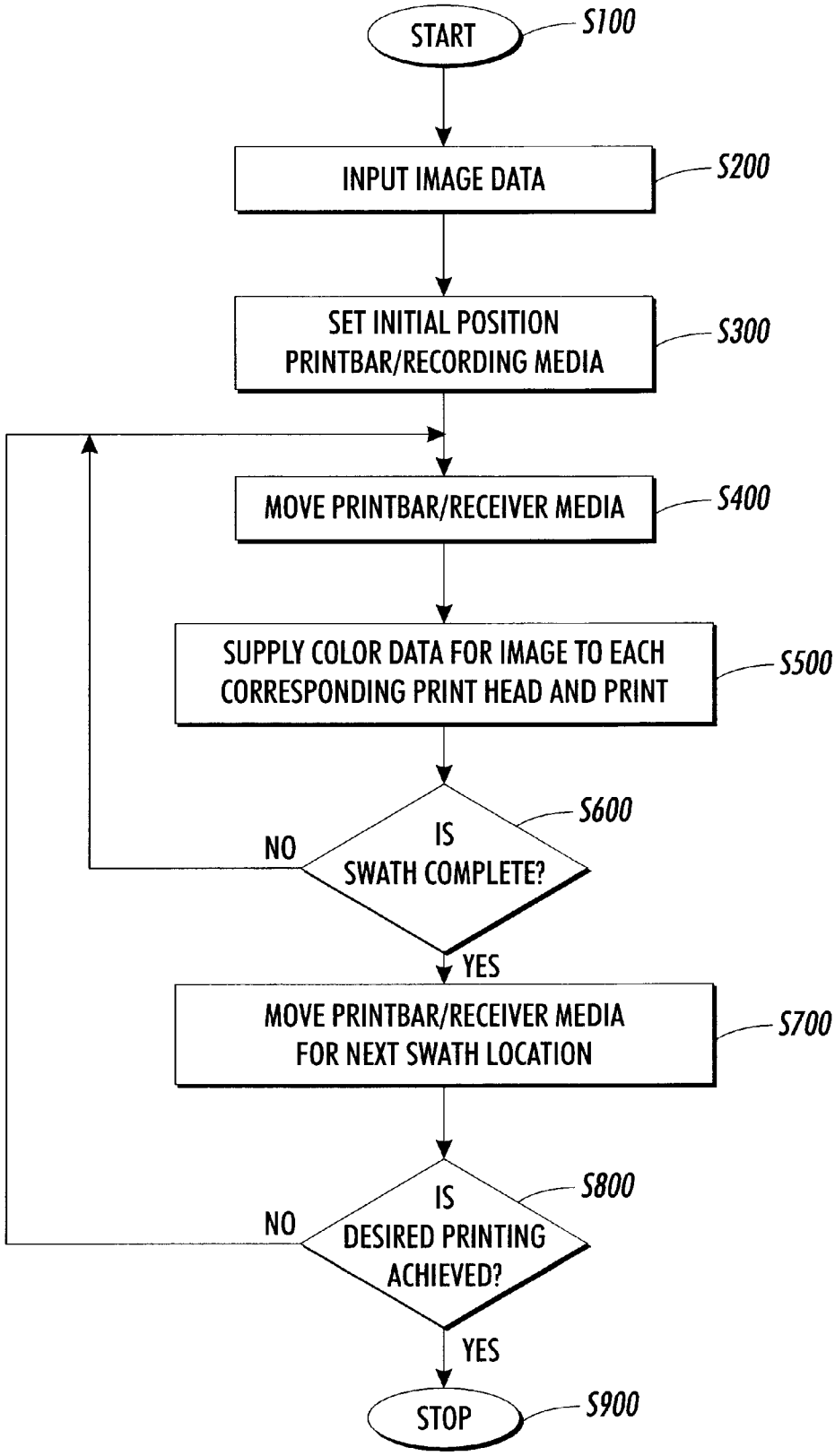
FIG. 9 is a flow-chart illustrating a first exemplary embodiment of a method of achieving full-width print coverage upon a recording medium where the printbar and/or the document handler is stepped to scan the sparsely populated printbar of FIG. 4 according to this invention.

FIG. 9 provides a flowchart outlines one exemplary embodiment of a method of achieving full-width printing information upon a recording medium using the sparsely populated printbar 200 of the various exemplary embodiments employing the stepping, recirculating or reciprocating methods according to this invention previously set forth. Beginning in step S100, the method continues to step S200, where image data is input to the printer. Then, in step S300, the printbar 200 and/or the document handler, for example the recirculating drum document handler 250, are set to initial printing positions. Next, in step S400, the printbar 200 and recording medium 230 are then moved relative to each other in the swath direction. The relative movements may be accomplished by either moving the printbar only, or the document handler only, or some combination of the two, as set forth in the exemplary embodiments shown in FIGS. 3–6. The method then continues to step S500. In step S500, image color data is supplied to each corresponding colored printhead die to provide a current swath for each printhead die for each set of printhead dies. Next, in step S600, a determination is made whether the current swath has been completed. If the current swath is not complete, the method returns to step S400. Otherwise, the method continues to step S700.

In step S700, the printbar 200 and/or document handler is moved in a step increment $d_s$ relatively across the recording medium so that a next swath can be printed. Then, in step S800, a determination is made whether the total stepping distances $xd_s$ is sufficient to obtain the desired full-width print coverage on the recording medium 230. If so, the method continues to step S900, where the method ends. Otherwise, if the desired full-width print coverage has not been obtained, the method jumps back to step S400.

Figure 10:
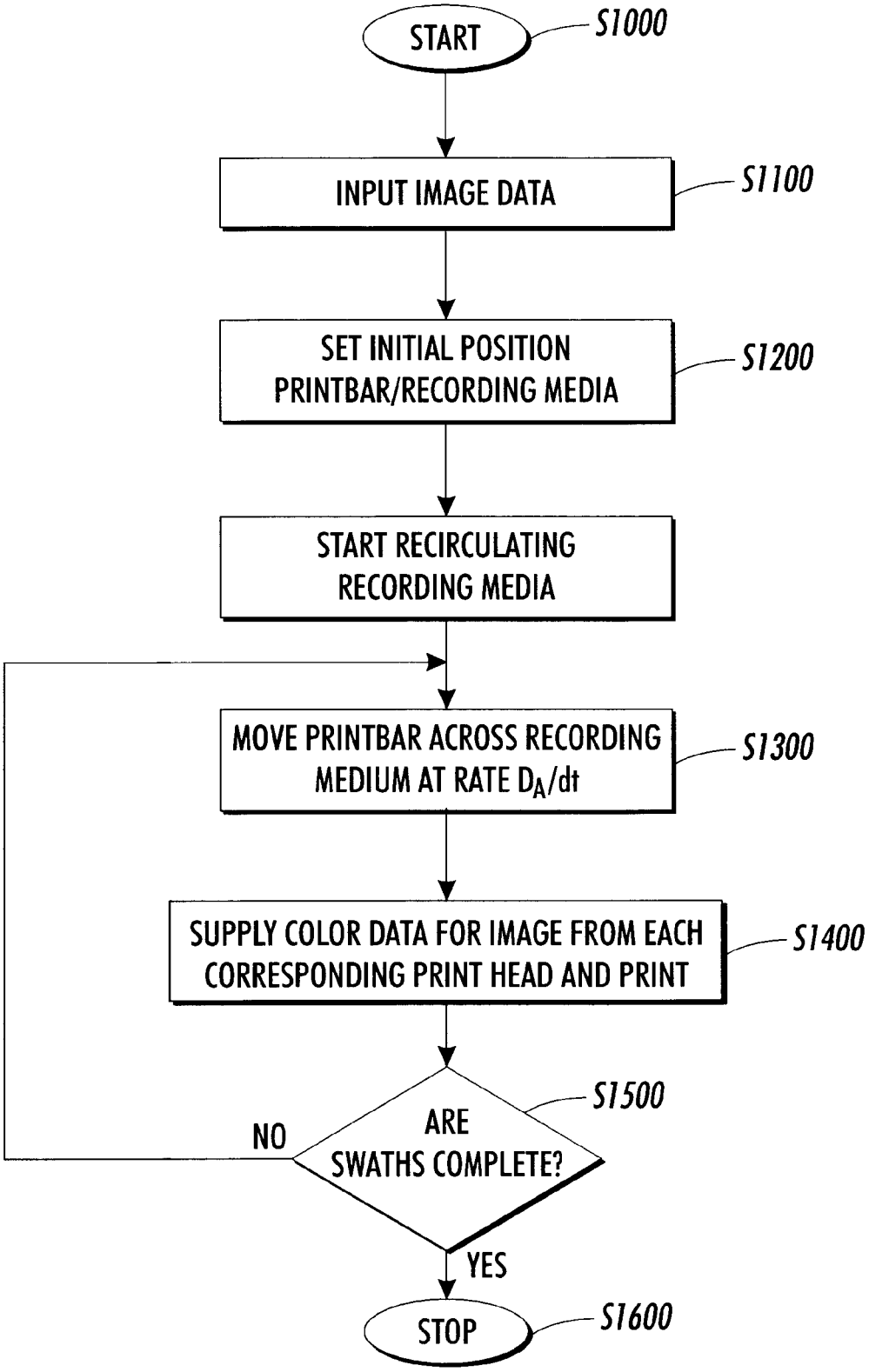
FIG. 10 is a flow-chart illustrating a second exemplary embodiment of a method of achieving full-width print coverage in "barber pole" fashion upon a recording medium according to this invention where the printbar is moved continuously relative to the document handler upon which the recording medium is mounted.

FIG. 10 provides a flowchart outlining one exemplary embodiment of a method of printing information upon a recording medium 230 in "barber pole" fashion using the sparsely populated printbar 200 of the various exemplary embodiments according to this invention set forth previously. Placement of "barber pole" sets of swaths 232, 234 and 236 requires the printbar 200 move "continuously" linearly relative to a recording medium 230 mounted upon a recirculating drum document handler 250. The method outlined in FIG. 9 begins in step S1000. The method continues in step S1100, where image data is input to the printer. Next, in step S1200, the printbar 200 and/or the recirculating drum document handler 250 are set to initial positions. Next, in step S1300, the printbar 200 is moved across the recording medium 230 at a constant rate of $d_a/d_t$. Then, in step S1400, the image color data inputted in step S1100 is supplied to each corresponding colored printhead die to provide a current angular or "barber pole" set of swaths to the recording medium 230 for each printhead die of differently colored ink. Next, in step S1500, a determination is made if the current set of swaths is complete to provide the desired full-width printing coverage. If the set of swaths is not complete, the method returns to step S1300. Otherwise, the method continues to step S1600, where the method ends.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A full-width printing system comprising:

a printbar;

a plurality of printhead dies attached to the printbar and forming a plurality of sets of printhead dies, each printhead of a first set of printhead dies being offset a first distance from a corresponding printhead of a neighboring set of printhead dies, and each printhead die within a set being spaced a second distance from a neighboring printhead die within the same set;

each printhead die including an array of ink-ejecting orifices, the ink-ejecting orifices of each printhead die being spaced from the ink-ejecting orifices of the other printhead dies;

a document handler that supports a recording medium upon which information will be placed in swaths from the ink-ejecting orifices of each printhead die; and at least one translation device that steps at least one of the printbar and the document handler in a plurality of directions to place successive swaths of the print information upon the recording medium, wherein the printbar and the document handler are each stepwise movable by one of the at least one translation device to place the successive swaths of the print information upon the recording medium, and wherein the printbar is moved laterally with respect to the document handler, and the document handler is simultaneously moved rotationally with respect to the printbar, such that the resultant swaths are placed on the recording medium at an angle with respect to the recording medium supported upon the document handler.

2. The full-width printing system of claim 1, wherein the printbar is stationary in at least a first one of the plurality of directions while the document handler is stepwise movable in at least the first direction by one of the at least one translation device to place the successive swaths of the print information upon the recording medium.

3. The full-width printing system of claim 1, wherein the document handler is stationary in at least a first one of the plurality of directions while the printbar is stepwise movable in at least the first direction by one of the at least one translation device to place the successive swaths of the print information upon the recording medium.

4. The full-width printing system of claim 1, wherein the printbar is movable by a first one of the at least one translation device while the document handler is movable by a second one of the at least one translation devices to place successive swaths of the print information upon the recording medium.

5. The full-width printing system of claim 4, wherein the printbar is movable laterally with respect to the document handler by the first translation device.

6. The full-width printing system of claim 4, wherein the document handler is movable rotationally with respect to the printbar by the second translation device.

7. A method of full-width printing on a recording medium using a printbar, a plurality of printhead dies attached to the printbar and forming a plurality of sets of printhead dies, each printhead of a first set of printhead dies being offset a first distance from a corresponding printhead of a neighboring set of printhead dies, and each printhead die within a set being spaced a second distance from a neighboring printhead die within the same set, the method comprising:

inputting image data to the printing system;

positioning at least one of the printbar or a document handler at a current position relative to the recording medium;

scanning the printbar and the document handler relative to each other while supplying print data to each corresponding printhead die to produce a current swath of printing information upon the recording medium;

determining whether the current swath is complete;

moving at least one of the printbar and the document handler a distance based on an array width of the printhead dies to a new current position to produce a next swath of the printing information, the next swath at least abutting an edge of the current swath; and repeating the scanning, supplying, determining and moving steps until full-width print coverage of the recording medium is achieved, wherein moving at least one of the printbar and document handler comprises moving at least one of the printbar and the document handler stepwise relative to a laterally stationary at least one of the printbar and the document handler based on the array width of the printhead dies, and wherein moving the printbar linearly laterally relative to the document handler moving rotationally comprises placing angular swaths of the printing information upon the recording medium supported on the rotationally moving document handler based on an array width of the printhead dies.

8. The method of claim 7, wherein each printhead die includes an array of ink-ejecting orifices, the ink-ejecting orifices of each printhead die being spaced from the ink-ejecting orifices of the other printhead dies.

9. The method of claim 7, further comprising supporting on the document handler a recording medium upon which recording medium print information will be placed in swaths from the ink-ejecting orifices of each printhead die.

10. The method of claim 7, wherein moving at least one of the printbar and document handler comprises stepping at least one of the printbar and document handler to place successive swaths of the printing information upon the recording medium until the full-width print coverage on the recording medium is achieved.

11. The method of claim 7, wherein moving at least one of the document handler and the printbar further comprises:

moving the document handler, which is laterally fixed in a stationary orientation relative to the printbar, rotationally relative to the printbar; and moving the printbar stepwise relative to the document handler based on the array width of the printhead dies.

12. The method of claim 7, wherein moving at least one of the printbar relative to a fixed, stationary document handler comprises moving the printbar stepwise laterally relative to the recording medium supported on the document handler.

13. The method of claim 7, wherein moving at least one of the document handler and the printbar further comprises:

moving the document handler rotationally relative to the printbar, which is laterally fixed relative to the document handler; and moving the document handler stepwise laterally relative to the printbar based on the array width of the printhead dies.

14. The method of claim 13, wherein moving at least one of the document handler and the printbar further comprises:

moving the printbar linearly laterally relative to the document handler, which is laterally fixed relative to the printbar; and moving document handler rotationally.

* * * * *